US011975887B1

(12) United States Patent
Blanchard et al.

(10) Patent No.: US 11,975,887 B1
(45) Date of Patent: May 7, 2024

(54) SHOCK-QUALIFIED STOWAGE PALLET

(71) Applicant: The Government of the United States of America as represented by the Secretary of the Navy, Newport, RI (US)

(72) Inventors: Monica L Blanchard, South Kingstown, RI (US); Matthew A Colavita, North Kingstown, RI (US)

(73) Assignee: The Government of the United States of America as represented by the Secretary of the Navy

( * ) Notice: Subject to any disclaimer, the term of this patent is extended or adjusted under 35 U.S.C. 154(b) by 512 days.

(21) Appl. No.: 17/470,113

(22) Filed: Sep. 9, 2021

(51) Int. Cl.
*B65D 19/00* (2006.01)

(52) U.S. Cl.
CPC ..... *B65D 19/0012* (2013.01); *B65D 2519/00273* (2013.01); *B65D 2519/00293* (2013.01); *B65D 2519/00323* (2013.01); *B65D 2519/00343* (2013.01); *B65D 2519/00373* (2013.01); *B65D 2519/00402* (2013.01); *B65D 2519/00567* (2013.01); *B65D 2519/00572* (2013.01); *B65D 2519/00746* (2013.01)

(58) Field of Classification Search
CPC ..... B65D 19/0012; B65D 2519/00273; B65D 2519/00293; B65D 2519/00323; B65D 2519/00343; B65D 2519/00373; B65D 2519/00402; B65D 2519/00567; B65D 2519/00572; B65D 2519/00746
USPC ..... 248/346.01
See application file for complete search history.

(56) References Cited

U.S. PATENT DOCUMENTS 3,617,040 A * 11/1971 Reinfeld ..... F27B 21/06 266/279
3,650,224 A * 3/1972 Petix ..... B65D 21/0204 108/56.1
5,105,746 A * 4/1992 Reynolds ..... B65D 19/44 108/56.1
5,769,376 A * 6/1998 Bostic ..... B65D 81/261 248/346.02
5,941,179 A * 8/1999 Herring ..... B65D 19/0095 108/56.3
8,701,570 B2 * 4/2014 Wilson ..... B65D 19/0016 108/56.1
11,427,379 B2 * 8/2022 Fitzgerald ..... B65D 19/004

* cited by examiner

*Primary Examiner* — Anita M King
(74) *Attorney, Agent, or Firm* — James M. Kasischke; Michael P. Stanley; Jeffry C. Severson

(57) ABSTRACT

A pallet includes a forward and an aft end block with a plurality of assemblies connected in series between the forward and aft end blocks. Each assembly includes a bottom plate extending along a horizontal plane and having a pair of opposite side edges and a top plate extending along a horizontal plane, parallel to the bottom plate, and having another pair of opposite side edges. Two tee sections are sandwiched between the top plate and the bottom plate. The horizontal portion of each tee section is attached to the bottom plate and the vertical portion of each tee section is attached to the top plate. An intermediate support connects a front end of one assembly to a back end of an adjacent assembly.

12 Claims, 8 Drawing Sheets

SHOCK-QUALIFIED STOWAGE PALLET

STATEMENT OF GOVERNMENT INTEREST

The invention described herein was made in the performance of official duties by employees of the U.S. Department of the Navy and may be manufactured, used, or licensed by or for the Government of the United States for any governmental purpose without payment of any royalties thereon.

BACKGROUND OF THE INVENTION

1) Field of the Invention

The present invention is directed to stowage pallets, and in particular to a shock qualified stowage pallet.

2) Description of the Related Art

The U.S. Navy has many vessels of all sizes and flexible storage space is at a premium. Sometimes, this space is used for stowage of a variety of hardware and payloads, and it may include a crane or hoist for moving loads. Pallets are generally used to maximize stowage space by allowing stacking and to protect the vessel's deck from the load. These pallets also raise the load above any liquid that may result from operations in the storage space. Another requirement is that the pallets be shock qualified so that they can support the load without collapse when the vessel is in extreme loading conditions.

Existing stowage solutions are installed on as many as five tracks built into the vessel's deck and rigidly supported. Using five tracks creates shorter unsupported lengths for the pallets. In newer vessels, reducing the number of tracks, from five to two, simplifies vessel construction and reduces weight. Thus, there is a need for pallets and stowage solutions that can be shock qualified, and allow significantly longer unsupported lengths.

SUMMARY OF THE INVENTION

The present invention discloses a structurally robust, deployable, and shock-qualified stowage pallet that can be unsupported over a wide span, is compatible with cranes and other handling systems in newer vessels, and is suitable for shock qualification. The stowage pallet utilizes structural top and bottom plates connected together by welded tee-shaped side rails. The stowage pallet has been analyzed and provided promising shock survivability and interface with the existing systems.

A stowage pallet herein includes a forward and an aft end block with a plurality of assemblies connected in series between the forward end block and the aft end block. Each assembly includes a bottom plate extending along a horizontal plane and having a first pair of two opposite side edges. A top plate extends along a horizontal plane parallel to the bottom plate and has a second pair of two opposite side edges. A pair of tee sections is sandwiched between the top plate and the bottom plate. The tee sections have a short leg and a long leg perpendicular to the short leg. The short leg is attached to the first pair of two opposite side edges, and the long leg is attached to the second pair of two opposite side edges. An intermediate support connects a front end of one assembly to a back end of an adjacent assembly.

The stowage pallet provides unique capabilities that are not available through other stowage solutions. Unlike previous stowage solutions, the stowage pallet is designed to fit in the compact storage spaces, to function with modern handling equipment, and to meet Grade B shock requirements. (Grade B shock covers items that are not essential but could become a hazard to the vessel's crew.) Additionally, this stowage pallet maximizes the stowage volume while reducing the required footprint, is modular and customizable, and accommodates a variety of stowed hardware. The stowage pallet described herein can be used in any environment requiring that the pallet be unsupported over a long span.

Further advantages of the present invention are realized in that the stowage pallet includes specific features to allow for a "shipping configuration," which will greatly reduce time and stress during shipping and installation. The stowage pallet is also designed to meet Grade B shock requirements. The stowage pallet was evaluated under a variety of loading conditions to ensure that stresses remained beneath the material's yield strength, and deflections remained within the allowable envelope to prevent interference with nearby structures in the surrounding stowage area. A shock qualified stowage pallet will improve safety, and prevent stowed items from being damaged or causing injury during a shock event.

The stowage pallet features a flat top plate design, which aims to maximize the stowage volume while reducing the footprint required in the storage area. By reducing the height of the stowage pallet, taller items can be stowed within the allowable space envelope. This is of paramount importance since space on vessels is extremely limited. The stowage pallet maximizes stowage volume while maintaining a minimal footprint.

The stowage pallet is modular, allowing for easier installation, removal, and replacement. The stowage pallet features removable top plates, which can be interchanged if damaged; this allows the welded frame to be reused for different equipment and extends the service life of the welded frame subassembly. Furthermore, if a stowed item requires a unique mounting pattern, the top plate can be removed, modified, and reinstalled to ensure proper alignment between the stowage pallet and the item. Shackle holes are provided to allow the top plates to be individually lifted in and out of the storage area via crane if necessary. The modular top plates of the final pallet concept provide easier installation and alignment, interchangeability, and extended service life.

The present invention provides a pallet allowing stowage of a variety of hardware and equipment. A flat structure features a structural bottom plate that sandwiches two tee-sections between itself and a removable top plate. The stowage pallet consists of multiple intermediate supports along the length to break the pallet into sections, allowing for modular shipping, and repair or replacement.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
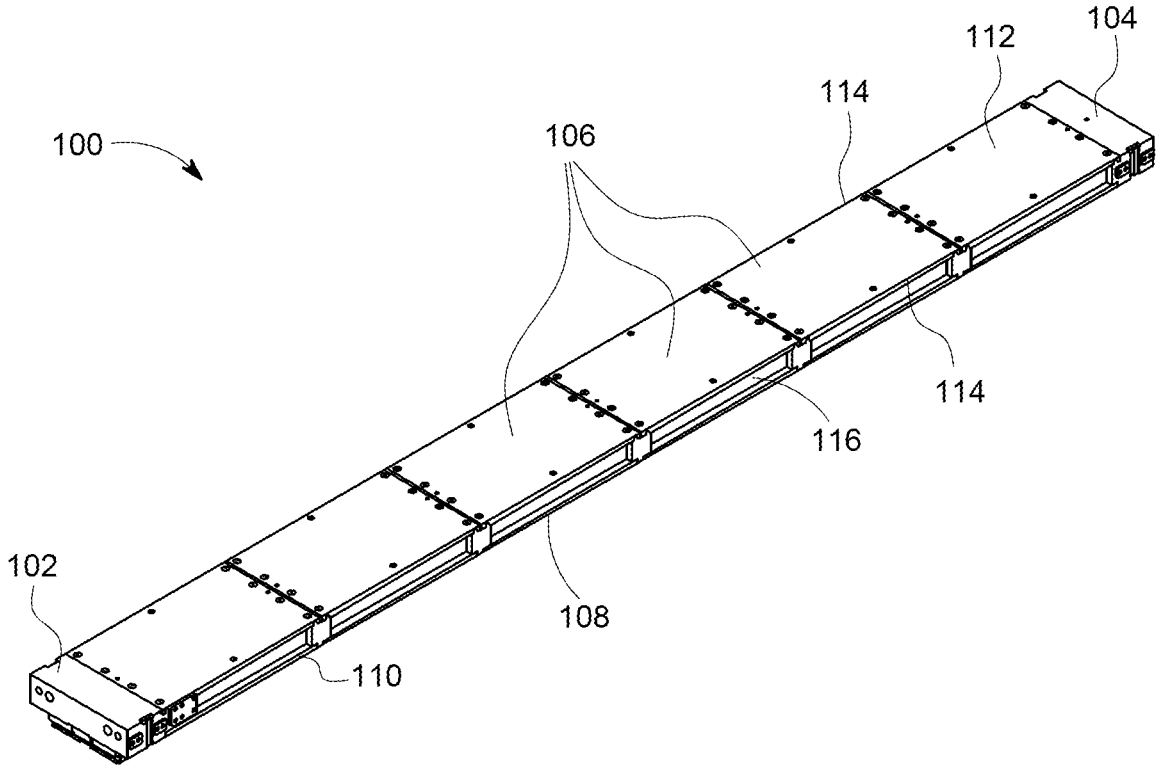
FIG. 1 is a perspective view of a stowage pallet of the present invention.

Referring to the drawings, FIG. 1 depicts an elongate stowage pallet 100. The stowage pallet 100 includes a forward end block 102 and an aft end block 104. Assemblies 106 are connected in series between the forward end block 102 and the aft end block 104. Each assembly 106 includes a bottom plate 108 extending along a horizontal plane and having a first pair of opposite side edges 110 and a top plate 112 extending along a horizontal plane parallel to the bottom plate 108 and having a second pair of opposite side edges 114. A pair of tee sections 116 is sandwiched between the top plate 112 and the bottom plate 108. The pair of tee sections 116 is parallel to each other, such that each assembly 106 forms a shallow box with the tee sections 116 being the sides of the box.

Figure 2:
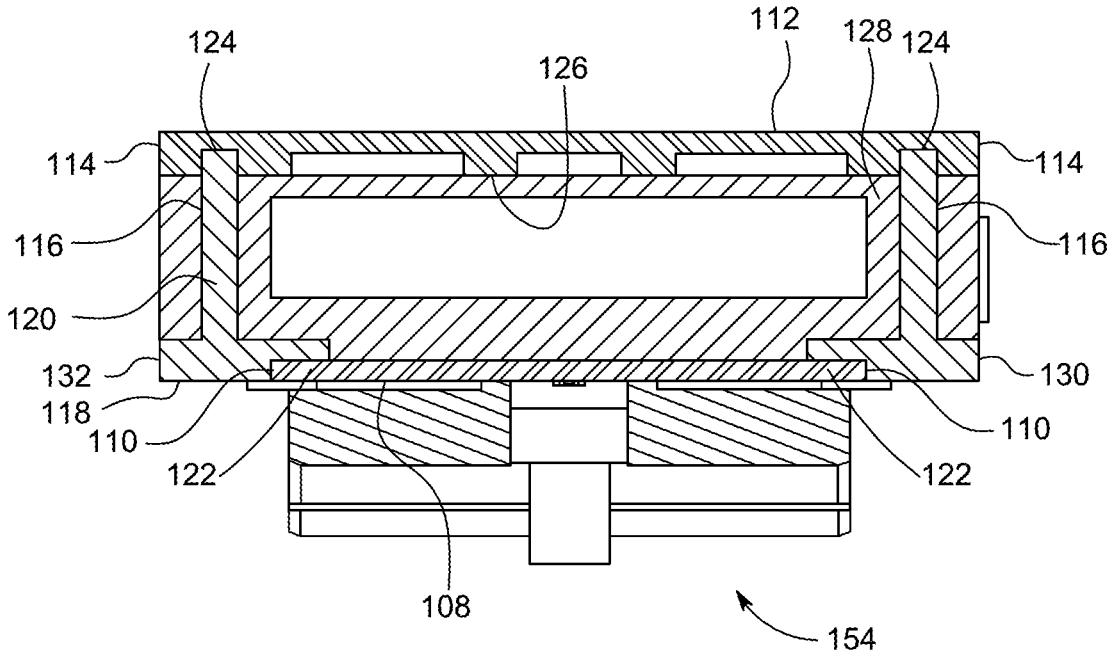
FIG. 2 is a cross-section of the stowage pallet.

A cross-section of the stowage pallet 100 is shown in FIG. 2. The tee sections 116 have a horizontal portion 118, sometimes referred to as the short leg, and a vertical portion 120, sometimes referred to as the long leg. The vertical portion 120 is perpendicular to the horizontal portion 118. The horizontal portion 118 is attached to the bottom plate 108 along the first pair of two opposite side edges 110. The horizontal portion 118 of each tee section 116 includes a cutout 122 formed in a bottom surface of the horizontal portion 118 toward the interior of the stowage pallet 100 for accommodating the bottom plate 108. The vertical portion 120 is attached to the top plate 112 along the second pair of two opposite side edges 114. The top plate 112 has side grooves 124 formed in a bottom surface 126 of the top plate 112. The side grooves 124 extend the length of the top plate 112 proximate the side edges 114 for accommodating the vertical portion 120 of each tee section 116.

The bottom plate 108, being a structural component, adds material located away from the neutral axis of the stowage pallet 100, resulting in a significantly stiffer cross-section. The tee sections 116 also improve stiffness of the stowage pallet 100 while minimizing the mass close to the neutral axis. Increased stiffness reduces deflection of the stowage pallet 100 under shock loading. The height of the vertical portion 120 of the tee sections 116 can be selected according to desired stiffness of the stowage pallet 100.

In some embodiments, the vertical portion 120 of the tee sections 116 is welded to the horizontal portion 118 in order to maximize the moment of inertia. A welded tee section 116 provides greater flexibility for the use of off-the-shelf stock material that provides considerably better material allowances for post-weld machining after the frame has been welded together Several assemblies 106 are connected in series between the forward end block 102 and the aft end block 104 by an intermediate support 128 that connects a front end of one assembly 106 to a back end of an adjacent assembly 106. The intermediate support 128 spans the width of the stowage pallet 100 from an outer edge 130 of the horizontal portion 118 of one tee section 116 to an outer edge 132 of the horizontal portion 118 of the parallel tee section 116. Tongue-and-groove construction is used to maximize the load transfer through the structural members of the stowage pallet 100 and decrease the loading on fasteners.

Figure 3:
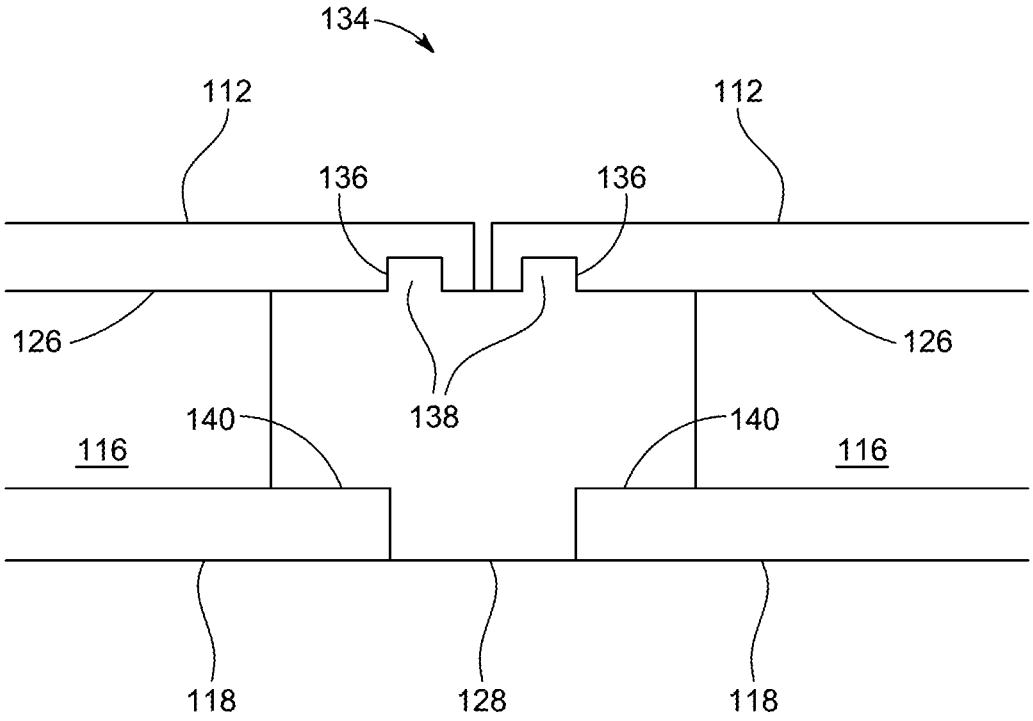
FIG. 3 is a side view of an intermediate support of the stowage pallet.
Figure 4:
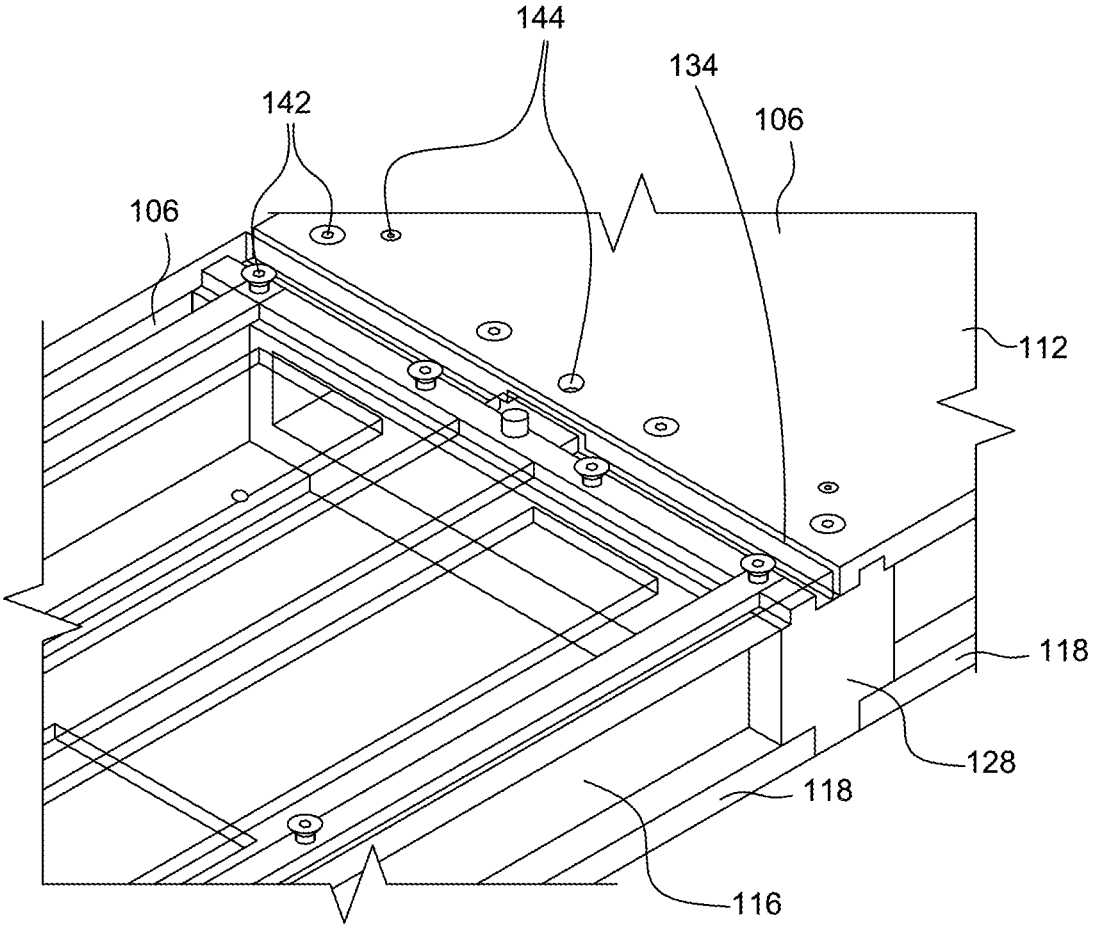
FIG. 4 is an enlarged view of intermediate supports of the stowage pallet.

Referring to FIG. 3 and FIG. 4, the intermediate support 128 includes a tongue-and-groove joint 134 in the interface between the top plate 112 and the tee-sections 116 of adjacent assemblies 106. Each top plate 112 has at least one end groove 136 formed in the bottom surface 126 of the top plate 112 proximate each end of the top plate 112. The intermediate support 128 has at least two tongue portions 138 at a top thereof and two insets 140 at a bottom thereof. The two tongue portions 138 span the width of the stowage pallet 100 from the outer edge 130 of the horizontal portion 118 of one tee section 116 to the outer edge 132 of the horizontal portion 118 of the parallel tee section 116. Likewise, the two insets 140 span the width of the stowage pallet 100 from the outer edge 130 of the horizontal portion 118 of one tee section 116 to the outer edge 132 of the horizontal portion 118 of the parallel tee section 116. The intermediate support 128 is retained between two adjacent assemblies 106 by the tongue-and-groove joint 134. One tongue portion 138 of the intermediate support 128 is received by the groove 136 of a first top plate 112 and the second tongue portion 138 is received by the groove 136 of a second adjacent top plate 112. The horizontal portion 118 of the tee section 116 of the first adjacent assembly 106 is positioned in one inset 140 of the intermediate support 128 and the horizontal portion 118 of the tee section 116 of the second adjacent assembly 106 is positioned in the other inset 140 of the intermediate support 128.

The top plate 112 is joined to the tee sections 116 and the intermediate support 128 by fasteners 142. Apertures are formed in the top plate 112 to allow the fasteners 142 to extend through the apertures into the vertical portion 120 of the tee sections 116 and into the tongue portion 140 of the intermediate support 128.

The stowage pallet 100 has removable top plates 112 that allow removal of damaged top plates or interchange with specially configured top plates. This allows the assembly 106 to be reused or reconfigured for different equipment and extends the service life of the assembly 106. Shackle holes 144 are included to allow a top plate 112 to be individually lifted in and out of the storage area via crane, if necessary.

Figure 5:
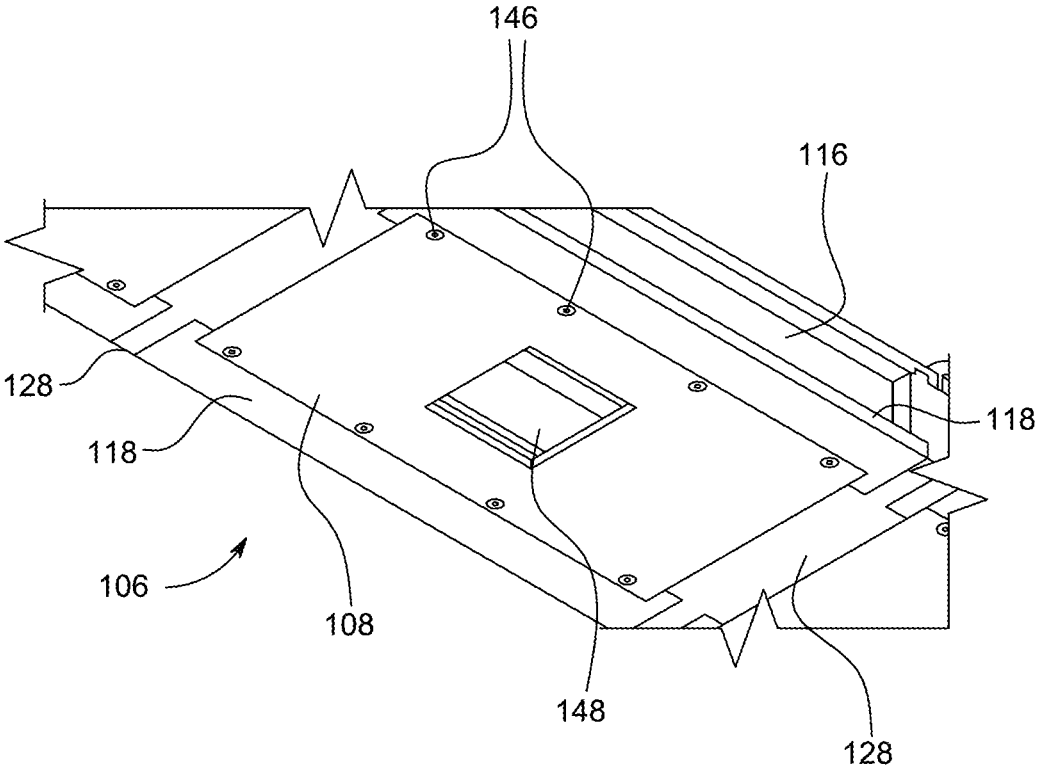
FIG. 5 is a bottom perspective view of the stowage pallet.

FIG. 5 shows a bottom perspective view of an assembly 106 of the stowage pallet 100. Apertures are formed in the bottom plate 108 to allow fasteners 146 to extend through the apertures into the horizontal portion 118 of the tee sections 116. The bottom plate 108 is secured to the horizontal portion 118 of the tee-sections 116 with fasteners 146 allowing the bottom plate 108 to be removed for access to the inside of the stowage pallet 100. This facilitates routing of cables (not shown) underneath the top plate 112. A cutout 148 in the bottom plate 108 provides access to the inside of the stowage pallet 100 without removing the bottom plate 108.

Figure 6:
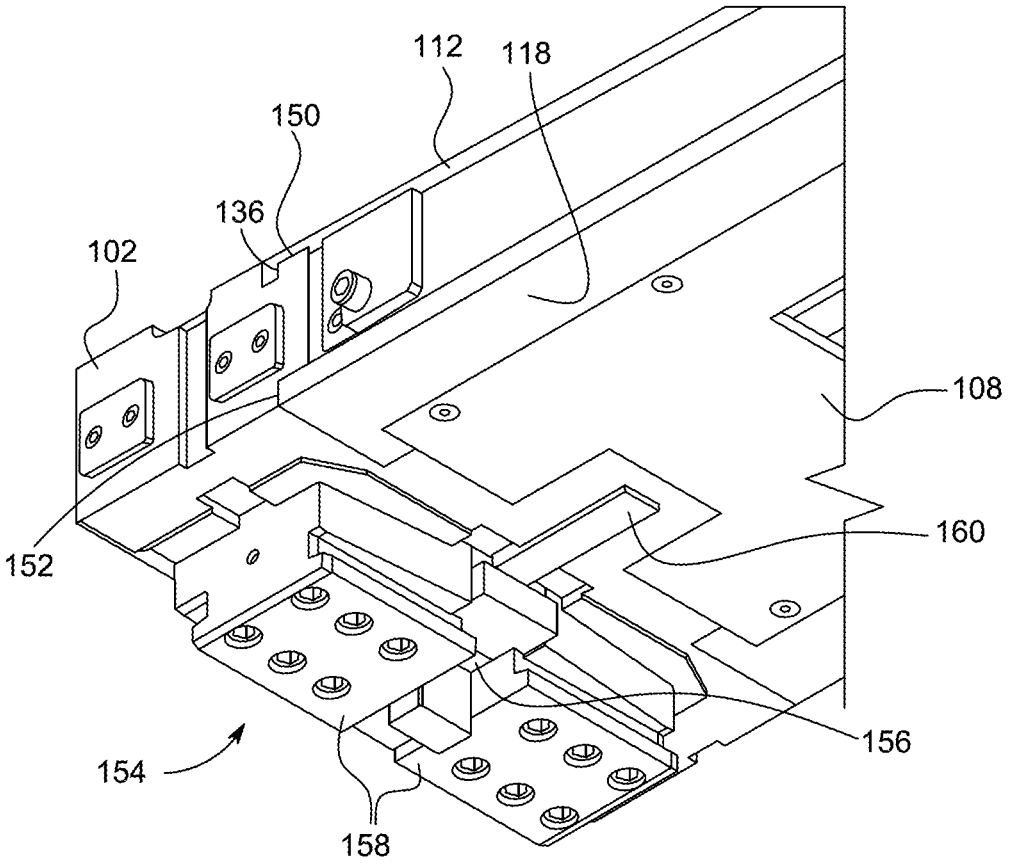
FIG. 6 is a bottom perspective view of a shoe subassembly.

Each of the forward end block 102 and aft end block 104 on the stowage pallet 100 is also connected to an assembly 106 by a tongue-and-groove joint between the top plate 112 and the respective end block 102, 104. Referring to FIG. 6, the forward end block 102 has a forward tongue portion 150 at a top thereof and an inset 152 at a bottom thereof. The forward tongue portion 150 of the forward end block 102 is received by the groove 138 of a top plate 112 of the assembly 106 at the forward end of the stowage pallet 100 and the horizontal portion 118 of the tee section 116 of the assembly 106 is positioned in the inset 152 of the forward end block 102. The aft end block 104 is similarly connected to an assembly 106 at the opposite end of the stowage pallet 100.

Furthermore, each of the forward end block 102 and aft end block 104 on the stowage pallet 100 includes a shoe subassembly 154 that allows the stowage pallet 100 to interface with the vessel's handling system. The shoe subassembly 154 includes a slot 156 for attachment to a shipping tray interlock cam and bumper pads 158. The geometry of the shoe subassembly 154 is identical to that of the cradle used for stowage and handling on the vessel. Use of the existing cradle with the shoe subassembly 154 mitigates platform interface and shock survivability risk. A dust cover 160 is provided to minimize the amount of debris in the interface between the shoe subassembly 154 and the cradle.

Figure 7:
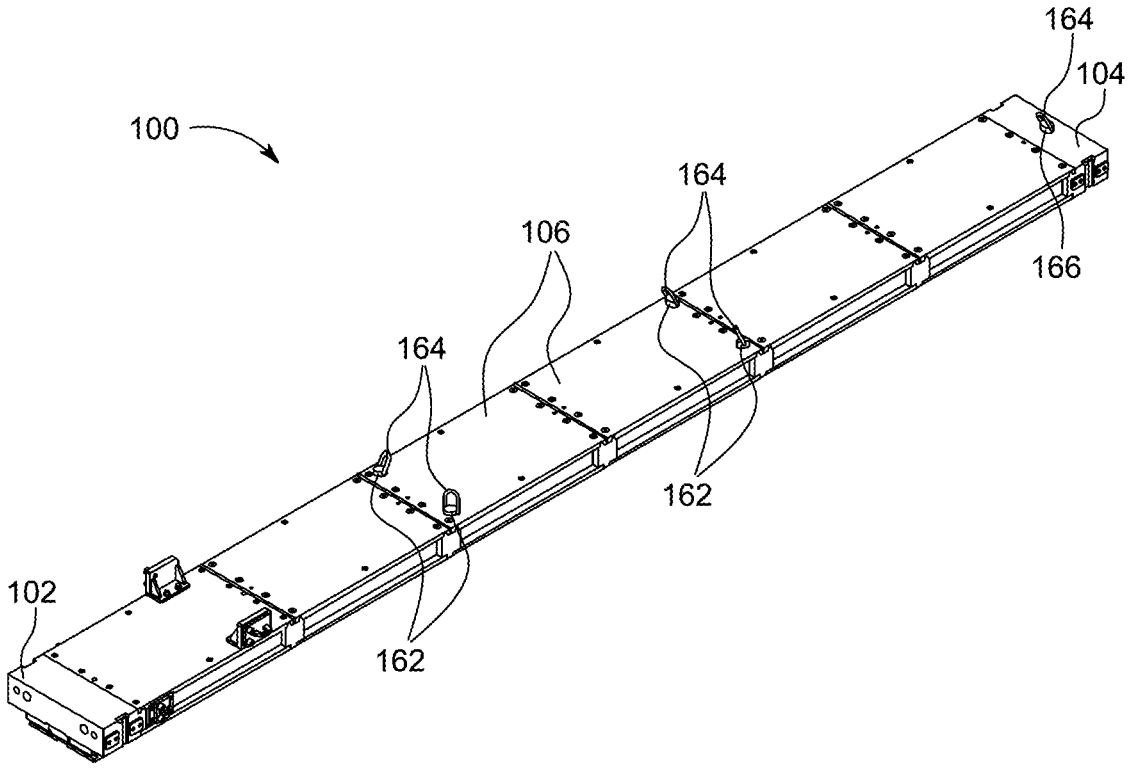
FIG. 7 is a perspective view of the stowage pallet in a shipping configuration.

The stowage pallet 100 also includes a shipping configuration, shown in FIG. 7. Four tapped holes 162 are supplied on the center two assemblies 106 of the stowage pallet 100 to enable installation of four swivel hoist rings 164 to be used for lifting the stowage pallet 100 with commercial-off-the-shelf (COTS) lifting equipment. A single tapped hole 166 is formed in the aft end block 104 to permit installation of another swivel hoist ring 164 for connecting lifting equipment to a hoist used for pivoting the stowage pallet in and out of the storage area during shipping operations.

Figure 8:
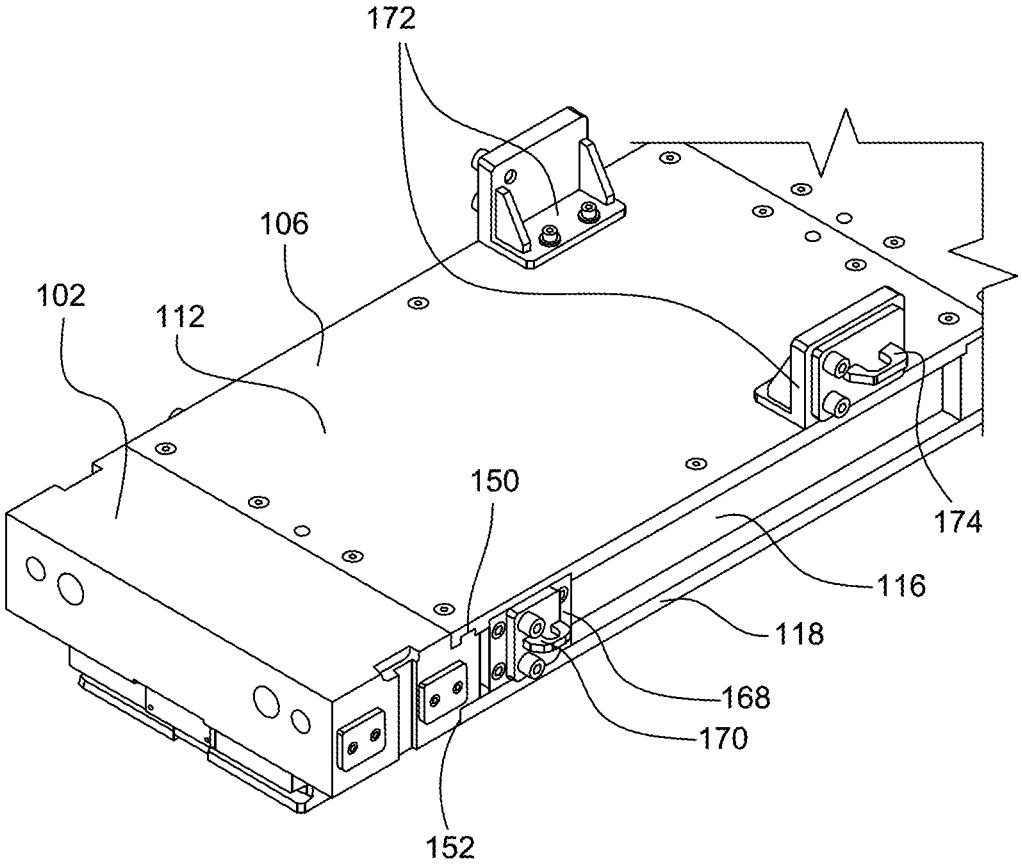
FIG. 8 is an enlarged view of the bracket attachments on the stowage pallet.

Referring to FIG. 8, the stowage pallet 100 also has a permanently mounted tapping pad 168 attached to the tee-sections 116 on the assembly 106 closest to the forward end block 102. This permanently mounted tapping pad 168 is used for snubber line padeyes 170. Temporarily mounted brackets 172 can be installed for outhaul line padeyes 174. Both padeye interfaces are designed to utilize the standard cradle outhaul and snubber line padeyes.

The invention has been described with references to specific embodiments. While particular values, relationships, materials, and steps have been set forth for purposes of describing concepts of the present disclosure, it will be appreciated by persons skilled in the art that numerous variations and/or modifications may be made to the invention as shown in the disclosed embodiments without departing from the spirit or scope of the basic concepts and operating principles of the invention as broadly described. It should be recognized that, in the light of the above teachings, those skilled in the art could modify those specifics without departing from the invention taught herein. Having now fully set forth certain embodiments and modifications of the concept underlying the present disclosure, various other embodiments as well as potential variations and modifications of the embodiments shown and described herein will obviously occur to those skilled in the art upon becoming familiar with such underlying concept. It is intended to include all such modifications, alternatives, and other embodiments insofar as they come within the scope of the appended claims or equivalents thereof. It should be understood, therefore, that the invention might be practiced otherwise than as specifically set forth herein. Consequently, the present embodiments are to be considered in all respects as illustrative and not restrictive.

Finally, any numerical parameters set forth in the specification and attached claims are approximations (for example, by using the term "about") that may vary depending upon the desired properties sought to be obtained by the present disclosure. At the very least, and not as an attempt to limit the application of the doctrine of equivalents to the scope of the claims, each numerical parameter should at least be construed in light of the number of significant digits and by applying ordinary rounding.

What is claimed is:

1. A stowage pallet comprising:

a forward end block;

an aft end block; and a plurality of assemblies connected in series between said forward end block and said aft end block, each said assembly comprising:

a bottom plate extending along a horizontal plane and having a first pair of two opposite side edges, a top plate extending along a horizontal plane parallel to said bottom plate and having a second pair of two opposite side edges;

a pair of tee sections each comprising a horizontal portion and a vertical portion perpendicular to the horizontal portion, wherein the horizontal portion of each tee section is attached to one of the first pair of two opposite side edges of said bottom plate and the vertical portion is attached to said top plate proximate to one of the second pair of two opposite side edges; and an intermediate support connecting a front end of one assembly to a back end of an adjacent assembly.

2. The apparatus in accordance with claim 1, wherein:

each of two adjacent said top plates has at least one groove formed in a lower surface thereof proximate each end of the top plate;

said intermediate support has at least two tongue portions at a top thereof and two insets at a bottom thereof; and said intermediate support is retained between adjacent assemblies by one tongue portion of said intermediate support being received by one groove of the first top plate and the second tongue portion of said intermediate support being received by one groove of the second adjacent top plate, said horizontal portion of a first tee section of the first adjacent assembly being positioned in one inset of said intermediate support and said horizontal portion of a second tee section of the second adjacent assembly being positioned in the other inset of said intermediate support.

3. The apparatus in accordance with claim 2, wherein:

said forward end block has at least one forward tongue portion formed on an upper surface thereof and an inset formed in a lower surface thereof;

said aft end block has at least one aft tongue portion formed on an upper surface thereof and an inset formed in a lower surface thereof;

said forward end block is retained by the forward tongue portion being received by one groove of the forward most top plate, said horizontal portion of said forward most tee section being positioned in the forward end block inset; and said aft end block is retained by the aft tongue portion being received by one groove of the aft most top plate, said horizontal portion of said aft most tee section being positioned in the aft end block inset.

4. The apparatus in accordance with claim 2, wherein said intermediate support spans the width of said stowage pallet.

5. The apparatus in accordance with claim 1, wherein said vertical portion of each of said pair of tee sections is longer than said horizontal portion.

6. The apparatus in accordance with claim 5, wherein a length of said vertical portion is selected for a desired stiffness of said stowage pallet.

7. The apparatus in accordance with claim 1, further comprising a cutout in said bottom plate providing access to the volume of the apparatus defined between said top plate, said bottom plate, and said pair of tee sections.

8. The apparatus in accordance with claim 1, further comprising a shoe subassembly connected to each of said forward end block and said aft end block, said shoe subassembly being configured for attachment to a preexisting track.

9. The apparatus in accordance with claim 1, wherein said top plate has a groove formed therein for accommodating the vertical portion of each tee section.

10. The apparatus in accordance with claim 9, wherein said top plate has apertures formed therethrough and said top plate is joined to said pair of tee sections by fasteners extending through said apertures to said tee section vertical portions.

11. The apparatus in accordance with claim 1, wherein said bottom plate has apertures formed therethrough and said bottom plate is joined to said pair of tee sections by fasteners extending through said apertures to said tee section horizontal portions.

12. The apparatus in accordance with claim 1, wherein said tee section horizontal portions have cutouts formed in a bottom surface thereof for accommodating said bottom plate.

* * * * *